US005282332A

United States Patent [19]

Philips

[11] Patent Number: 5,282,332

[45] Date of Patent: Feb. 1, 1994

[54] STUN GUN

[76] Inventor: Elizabeth Philips, 195 SW. 15th Rd., Suite 203, Miami, Fla. 33129

[21] Appl. No.: 857,680

[22] Filed: Mar. 25, 1992

Related U.S. Application Data

[63] Continuation-in-part of Ser. No. 651,285, Feb. 1, 1991, abandoned.

[51] Int. Cl.[5] ..... F41H 9/10

[52] U.S. Cl. ..... 42/1.08; 42/1.09; 273/84 ES

[58] Field of Search ..... 89/1.11; 42/1.08, 1.09, 42/1.16, 52, 53; 273/84 ES

[56] References Cited

U.S. PATENT DOCUMENTS

| | | | |
|---|---|---|---|
| 1,158,473 | 11/1915 | Floyd | 273/84 ES |
| 1,484,650 | 2/1924 | Joriot | 42/52 |
| 2,176,994 | 10/1939 | Hansen et al. | 273/84 ES |
| 3,362,711 | 1/1968 | Larsen et al. | 273/84 ES |
| 3,885,733 | 5/1975 | Klebold et al. | 273/84 ES |
| 3,998,459 | 12/1976 | Henderson et al. | 273/84 ES |
| 4,753,446 | 6/1988 | Mills | 211/70.2 |
| 4,843,336 | 6/1989 | Kuo | 42/1.08 |
| 4,982,645 | 1/1991 | Abboud | 89/1.11 |

FOREIGN PATENT DOCUMENTS

| | | | |
|---|---|---|---|
| 2530088 | 1/1984 | France | 42/1.09 |

*Primary Examiner*—Stephen M. Johnson
*Attorney, Agent, or Firm*—Malin, Haley, DiMaggio & Crosby

[57] ABSTRACT

A stun gun that is disguised as a collapsed umbrella and includes an elongated tubular body sized in length and diameter to that of a conventional collapsed umbrella, a curved umbrella-like handle attached at one end, and electrodes disposed at the opposite end and a power supply and circuit voltage generator for providing a large voltage across the electrodes.

12 Claims, 3 Drawing Sheets

STUN GUN

This application is a continuation of application Ser. No. 07/651,285, filed Feb. 1, 1991, now abandoned.

BACKGROUND OF TEN INVENTION

This invention relates generally to stun guns, and specifically to a stun gun disguised as a collapsed umbrella, the stun gun including an improved holding grip.

Stun guns are classified as self-defense weapons which can administer a large electrical shock to a person or animal partially paralyzing most persons for a short period of time allowing the stun gun operator to either escape, call for help, or further subdue a would-be attacker.

Most stun guns that are commercially available are cylindrical in shape, with a pair of electrodes at one end, and a gripping area that is formed around the circumference of the stun gun body. Their shape and weight and the grip location often make them awkward to hold or grasp especially when in use.

One of the problems in successfully using a stun gun is that the electrical probes, generally disposed at one end, must come into contact with the body of the person to be stunned for at least a few seconds. Hence the element of surprise by the user can be important. However, once a would-be attacker realizes that the user has a stun gun, evasive action can be taken to avoid contact of the electrodes. Knowledge of the presence of the stun gun could elicit even more aggressive behavior once it is realized the user is holding a stun gun.

The present invention overcomes these problems by providing a stun gun that looks like a collapsed umbrella because the stun gun is formed from a narrow, cylindrical body and includes a curved handle at one end that is used as a grip. Therefore the stun gun can be carried in full view, appearing as a collapsed umbrella.

BRIEF SUMMARY Of THE INVENTION

A stun gun having an improved handle and an overall appearance or disguise as a collapsed umbrella comprising an elongated tubular body proportioned in length and diameter to appear as a collapsed umbrella, said body also acting as a housing for high voltage generation circuitry and a portable power source of electricity, a pair of electrodes disposed through a cap connected at one end of said- elongated body and connected to the electrical circuitry therein, and an activating switch mounted near the handle.

A curved handle or hand grip is firmly mounted to the tubular body at the end opposite the electrodes. The curved handle may be "C"-shaped and tapered and covered with a suitable material such as leather or vinyl to appear as an umbrella handle. An electrical switch which actuates the stun gun is disposed near the handle connection on the elongated tubular body.

The elongated tubular body may be constructed of threadably connected sections making the interior accessible for the removal or replacement of batteries. In such an embodiment a second tubular segment is threadably connected to a first tubular segment forming the housing which is also threadably connected to the handle.

It is an object of this invention to provide an improved stun gun that may be more effectively utilized by the user.

It is another object of this invention to provide a stun gun that is disguised as a collapsed umbrella.

It is yet another object of this invention to provide a stun gun with an curved handle that improves hand support and operation of the stun gun.

In accordance with these and other objects which will be apparent hereinafter, the instant invention will now be described with particular reference to the accompanying drawings.

PREFERRED EMBODIMENT OF THE INVENTION

Figure 1:
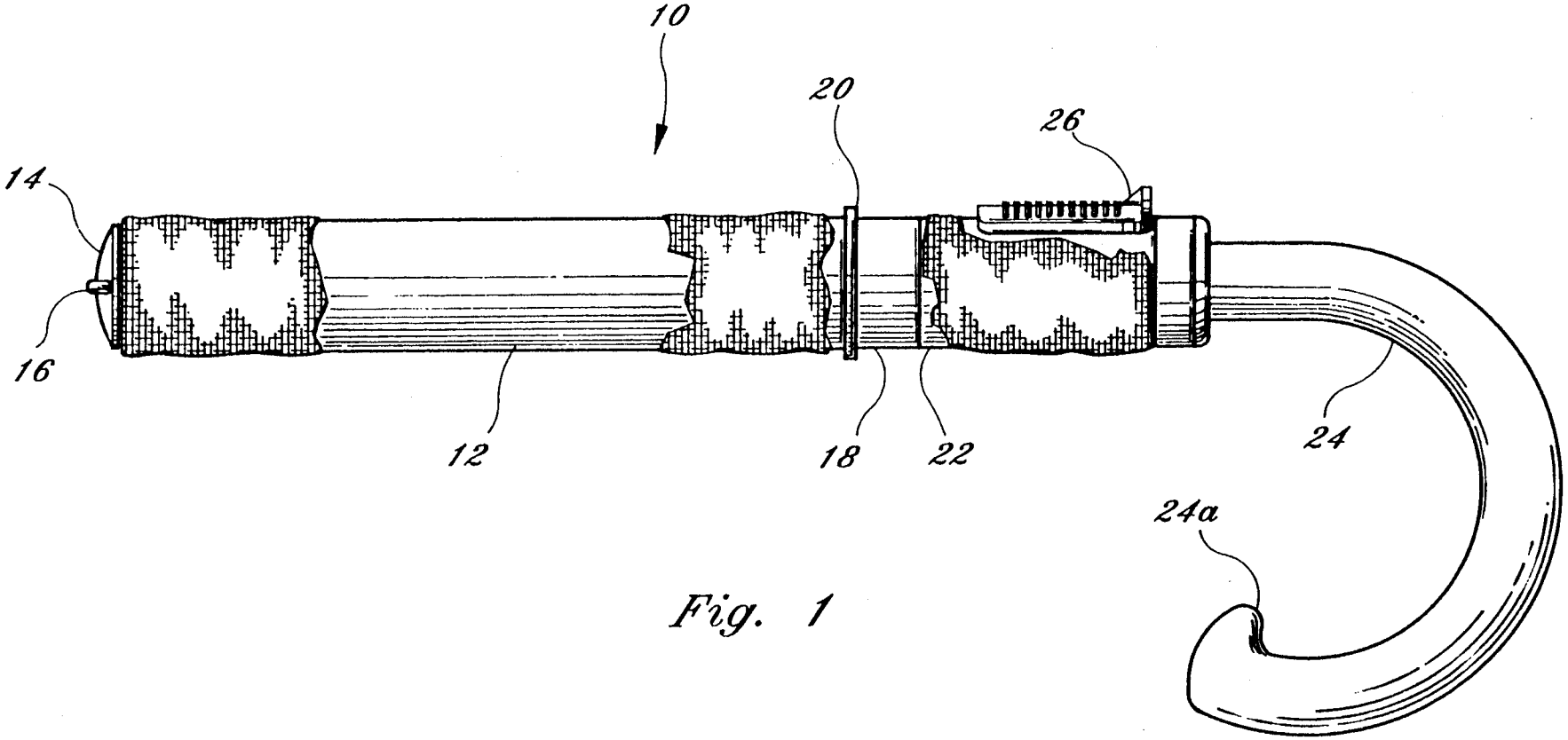
FIG. 1 shows a side elevational view of the present invention.

Referring now to the drawings and specifically FIG. 1, the present invention is shown generally at 10 comprised of a tubular body 12 which is hollow to form a housing, having a slip cap 14 fitted into one end of tubular body 12 and a pair of protruding stainless steel prongs 16 which act as electrodes projecting through the slip cap 14. The slip cap 14 may be constructed of a non-rubber PVC (polyvinylchloride) plastic.

The electrical circuitry that generates the high voltage at the electrodes is well known and does not itself form part of this invention and Is therefore not described in detail.

At the end opposite the electrodes 16, a slip coupling 18 which has threaded portions Inside is attached to the tubular body 12. A rubber gasket 20 is connected therebetween. A tubular PVC coupling 22 which also includes threaded portions is connected at one end to the slip cup 18 and includes an electrical switch 26 mounted therethrough that is electrically connected to the battery (not shown) and the high voltage generating circuitry.

A curved handle 24 which is aesthetically constructed like an umbrella handle is essentially C-shaped and is threadably connected to coupling 22. The texture of the handle could be leather or vinyl to enhance the overall appearance as an umbrella while improving gripping and holding for maneuvering the stun gun. The handle terminates at curved portion **24*a***.

The inside of hollow tubular body 12 forms a housing that receives circuitry (not shown) for generating a large electrical voltage (usually several thousand volts) and a battery. The voltage generating circuitry is connected to the electrode 16.

Figure 2:
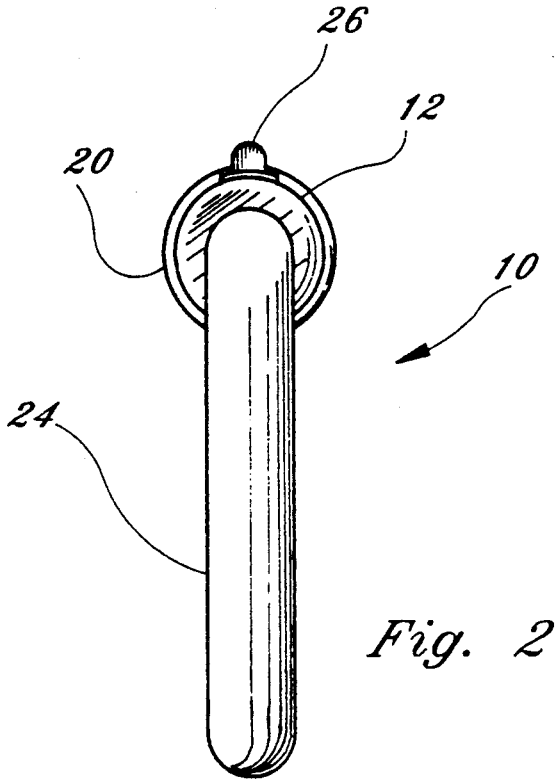
FIG. 2 shows an end elevational view of the present invention.

Referring now to FIG. 2, the invention is shown at 10 with the umbrella shaped handle 24 mounted at one end including the actuating switch 26 mounted just before and above the handle for convenient access.

Figure 3:
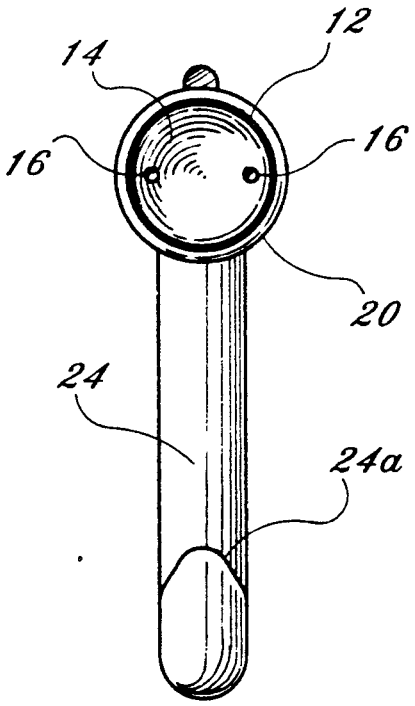
FIG. 3 shows an end elevational view of the present invention opposite that shown in FIG. 2.

FIG. 3 shows the stainless steel probes 16 (the electrodes) protruding through the slip cap 14 which is firmly mounted in body 12. The hemispherically shaped cap 14 gives the appearance of the end portion (canopy center) of an umbrella.

Handle 24 includes a small curved tip portion **24*a*** resembling that of an umbrella handle which helps to prevent the stun gun from being inadvertently dropped.

Figure 4:
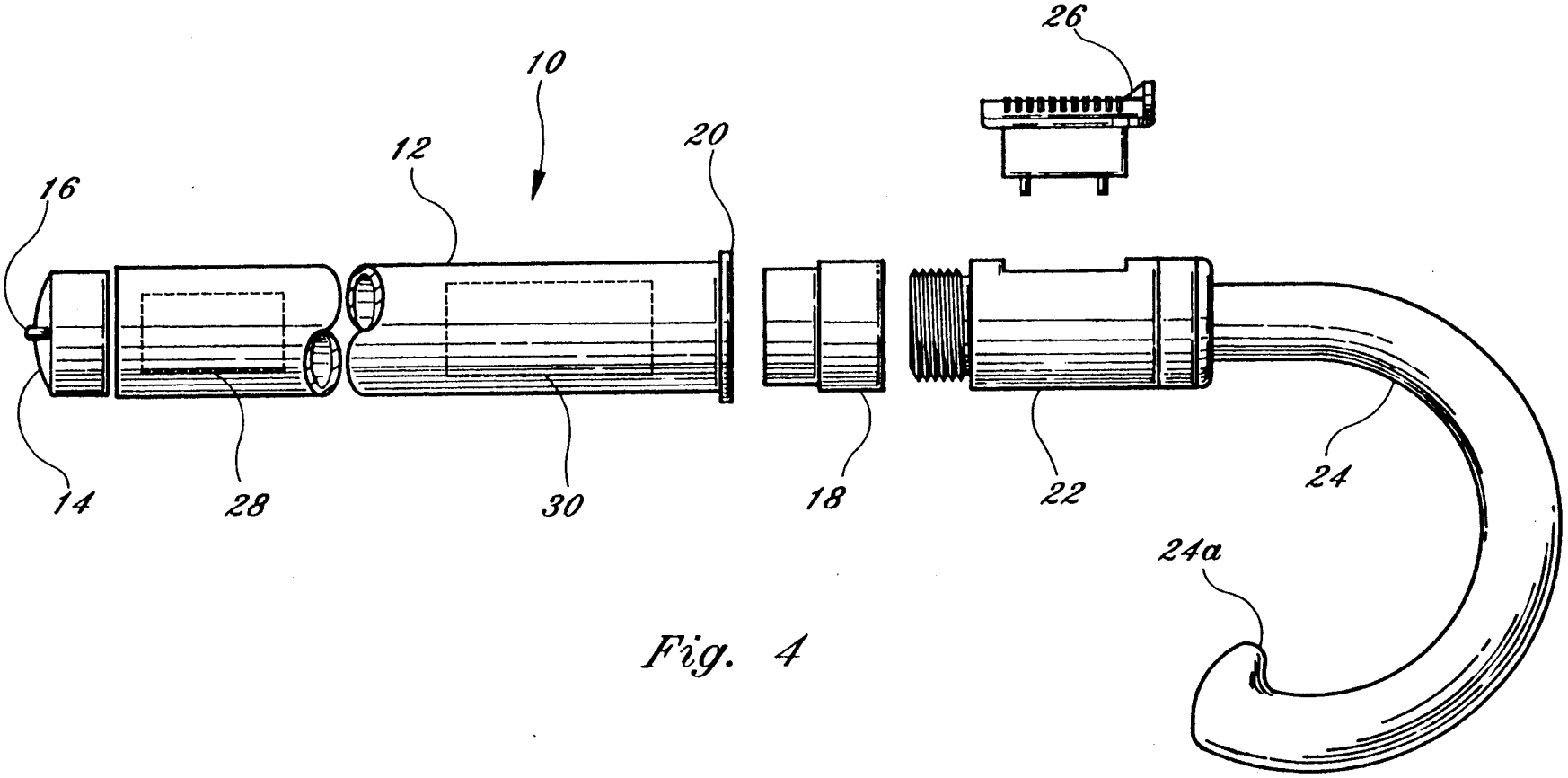
FIG. 4 shows an exploded side elevational view showing exterior structural members of the invention.

FIG. 4 shows how in one embodiment the invention may be assembled and also includes a diagrammatic box 28 representative of the internal circuitry that provides the electrical high voltage to probe electrodes 16 and diagrammatic box 30 which is representative of a battery which is also connected to circuitry 28 and switch 26.

The slip cap 14 may be glued within tubular body 12 while the stainless steel probe electrodes 16 protrude through the slip cap 14.

At the other end of the stun gun, the handle 24 is attached directly to coupling 22 which also houses switch 26. Coupling 22 is itself threadably connected to slip coupling 18 connected to tubular housing 12 with a rubber gasket 20 disposed therebetween.

The male threaded connector 22*a* is provided so that access may be gained to the interior of body 12 to change batteries or the like.

Note that by providing an elongated tubular shape and diameter in the proportions of a collapsed umbrella combined with a slip cap end and a curved handle, viewing FIG. 1, it is clear that the stun gun has the appearance of a collapsed umbrella.

To activate the invention and generate high voltage across electrodes 16, one needs only to depress switch 26. To deactivate the invention, the switch 26 is turned off.

A primary importance of the invention is the fact that because the stun gun clearly resembles an umbrella, the stun gun can be carried at all times in full view without disclosing to others nearby that the object is actually a stun gun. This disguise of the stun gun will allow for its most effective use in that the user has the element of surprise. Secondly the curved handle provides the user with a firm gripping and support member to aid in manipulating the end probes of the stun gun into position when necessary. Switch location near the handle also makes the invention much easier to operate than a conventional stun gun.

The instant invention has been shown-and described herein in what it is considered to be the most practical and preferred embodiment. It is recognized, however, that departures may be made therefrom within the scope of the invention and that obvious modifications will occur to a person skilled in the art.

I claim:

1. A stun gun comprising:
an elongated tubular body sized in length and diameter to resemble a collapsed umbrella;
an electrode protruding from one end of said elongated body;
circuit means for generating a large voltage connected to said electrode within said tubular body;
electrical power supply means connected to said circuit means within said tubular body;
means for actuating said voltage generating means connected to said power supply means; and
a curved handle, said handle removably connected to said elongated tubular body at the end opposite said electrode to allow said electrical power supply means to be inserted within said tubular body, said handle having a textured surface to provide the appearance of an umbrella handle.

2. A stun gun as in claim 1, wherein:
said handle includes first segment having an axis that is coaxial with said elongated tubular body and a second C-shaped curved segment.

3. A stun gun as in claim 1, wherein:
said handle textured surface consists of a leather covering.

4. A stun gun as in claim 1, including:
a hemispherically shaped cap connected to one end of said elongated body, said electrode being connected through said hemispherically shaped cap.

5. A stun gun comprising:
an elongated tubular hollow body sized in length, diameter and exterior surface configuration to resemble a collapsed umbrella, said tubular body having a first end and a second end;
a cap having at least one electrode projecting through said cap, said cap being fitted at the first end of said tubular body;
circuit means for generating a large voltage, said circuit means connected to said electrode and disposed within said tubular body;
electrical power supply means connected to said circuit means and disposed within said tubular body;
switch means for actuating said circuit means, said switch means connected to said power supply means; and
a curved handle, said handle removeably connected to said second end to allow said electrical power supply means to be inserted within said tubular body, said handle having a textured surface to provide the appearance of an umbrella handle, said handle including a small top portion to help prevent the stun gun from being inadvertently dropped, said switch means disposed near said handle for ease in operation;
whereby the stun gun resembles a conventional umbrella allowing the stun gun to be carried at all times in full view without disclosing to others nearby that what appears to said conventional umbrella is actually said stun gun.

6. The stun gun of claim 5, wherein said handle includes a first segment having an axis that is coaxial with said elongated tube and a second C-shaped curved segment.

7. The stun gun of claim 5, wherein said handle textured surface consists to a leather covering.

8. The stun gun of claim 5, wherein said cap is hemispherically shaped.

9. A stun gun disguised as an umbrella comprising:
an elongated hollow tubular body sized in length and diameter to resemble a collapsed umbrella, said tubular body having a first and second end;
a cap operatively associated with the first end of said tubular body, said cap having at least one electrode projecting through said cap;
circuit means for generating a large voltage, said circuit means operatively associated with the electrode and disposed within said tubular body.
electrical power supply means operatively associated with said circuit means, said electrical power supply means disposed within said tubular body;
switch means operatively associated with said circuit means and said electrical power supply means; and
a curved substantially C-shaped handle removably connected to the second end of said tubular body to allow said electrical power supply means to be inserted within said tubular body and for allowing said electrical power supply means to be replaced, said handle having a textured surface to provide the appearance of an umbrella handle.

10. The stun gun of claim 9, wherein said electrical power supply means is a battery.

11. The stun gun of claim 9, wherein said switch means is disposed within said handle within a user's finger reach.

12. The stun gun of claim 9, wherein said handle textured surface consists of a leather covering.

* * * * *